US008167385B2

(12) United States Patent
Park et al.

(10) Patent No.: US 8,167,385 B2
(45) **Date of Patent: *May 1, 2012**

(54) WASHING MACHINE

(75) Inventors: Hye-yong Park, Changwon-si (KR); Bo Yeon Kim, Changwon-si (KR); Dae Hee Kwon, Busan-si (KR); Hyun Seok Kim, Seoul (KR); Seong Yeol Lee, Daegu-si (KR)

(73) Assignee: LG Electronics Inc., Seoul (KR)

( * ) Notice: Subject to any disclaimer, the term of this patent is extended or adjusted under 35 U.S.C. 154(b) by 877 days.

This patent is subject to a terminal disclaimer.

(21) Appl. No.: 11/885,860

(22) PCT Filed: Mar. 7, 2006

(86) PCT No.: PCT/KR2006/000795

§ 371 (c)(1),
(2), (4) Date: Oct. 6, 2008

(87) PCT Pub. No.: WO2006/095998

PCT Pub. Date: Sep. 14, 2006

(65) Prior Publication Data

US 2009/0033185 A1 Feb. 5, 2009

(30) Foreign Application Priority Data

Mar. 8, 2005 (KR) ..... 10-2005-0019142
Mar. 8, 2005 (KR) ..... 10-2005-0019143
Mar. 8, 2005 (KR) ..... 10-2005-0019144
Apr. 15, 2005 (KR) ..... 20-2005-0010496

(51) Int. Cl.
*D06F 39/04* (2006.01)

(52) U.S. Cl. ..... 312/204; 68/3 R; 68/24; 312/228

(58) Field of Classification Search ..... 312/228, 312/265.5, 265.6, 204, 237; 68/196, 142, 68/3 R, 23 R, 24, 58, 139
See application file for complete search history.

(56) References Cited

U.S. PATENT DOCUMENTS

| | | | | |
|---|---|---|---|---|
| 3,253,874 | A * | 5/1966 | Czech | 312/265.5 |
| 3,294,461 | A * | 12/1966 | Barnard et al. | 312/213 |
| 3,773,399 | A * | 11/1973 | Sulcek | 312/204 |
| 5,496,104 | A * | 3/1996 | Arnold et al. | 312/204 |
| 7,275,398 | B2 * | 10/2007 | Kim et al. | 68/3 R |
| 7,748,243 | B2 * | 7/2010 | Park et al. | 68/196 |
| 2004/0107738 | A1 * | 6/2004 | Kim et al. | 68/3 R |
| 2007/0180868 | A1 * | 8/2007 | Hur | 68/3 R |
| 2007/0209403 | A1 * | 9/2007 | Byun et al. | 68/3 R |
| 2008/0223085 | A1 * | 9/2008 | Park | 68/139 |
| 2009/0066205 | A1 * | 3/2009 | Park et al. | 312/228 |

FOREIGN PATENT DOCUMENTS

| | | | |
|---|---|---|---|
| DE | 10101217 | A1 | 7/2002 |
| GB | 2071706 | A | 9/1981 |
| GB | 2243770 | A | 11/1991 |
| JP | 2001-269498 | | 10/2001 |
| TW | M256655 | | 2/2005 |

* cited by examiner

*Primary Examiner* — Janet M Wilkens
(74) *Attorney, Agent, or Firm* — McKenna Long & Aldridge LLP

(57) ABSTRACT

Provided is a washing machine. The washing machine includes a front portion that forms the front of the washing machine and a deco panel. The deco panel is installed around the perimeter of the front portion to cover the front portion.

27 Claims, 8 Drawing Sheets

[Fig. 1]
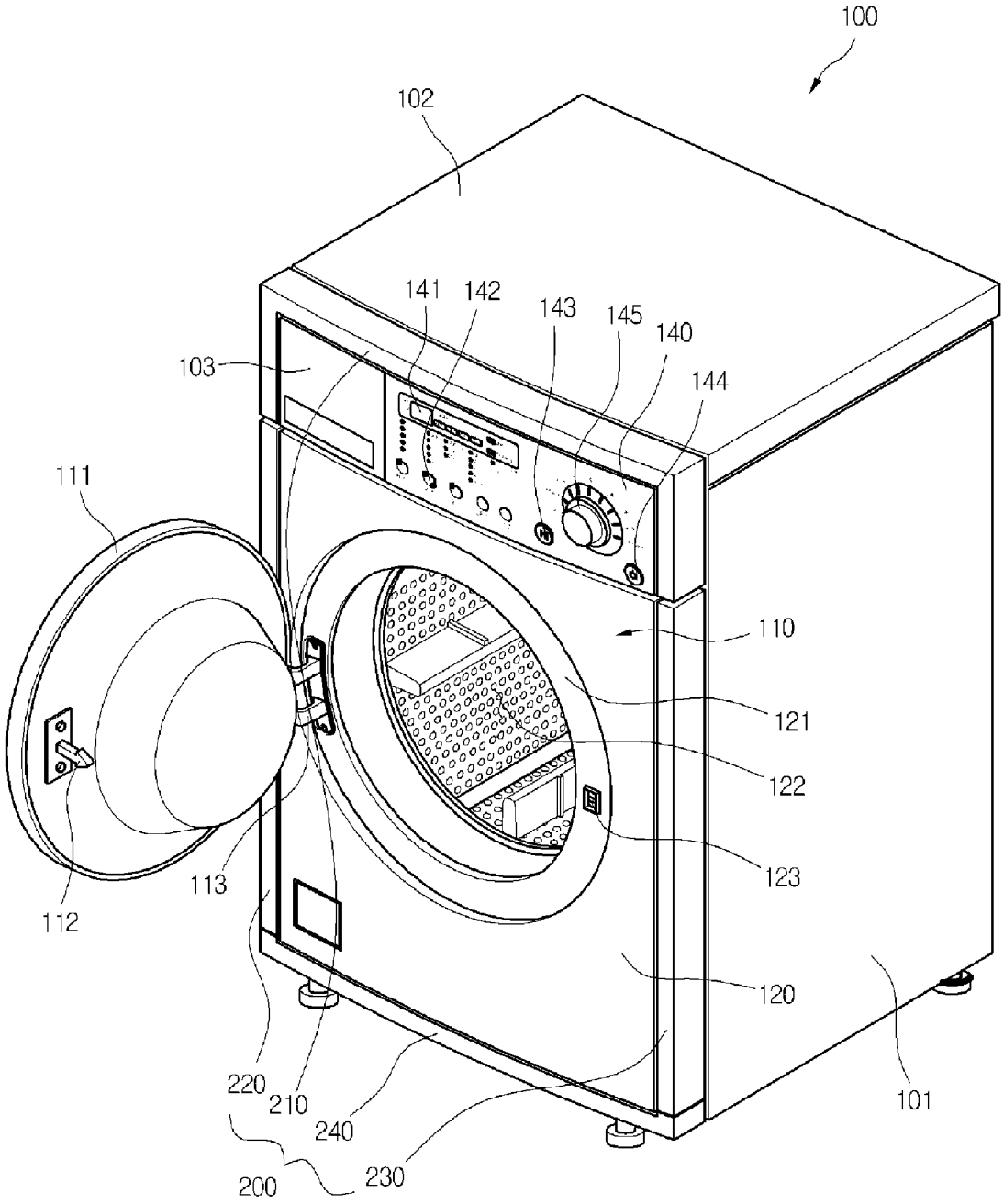

[Fig. 2]
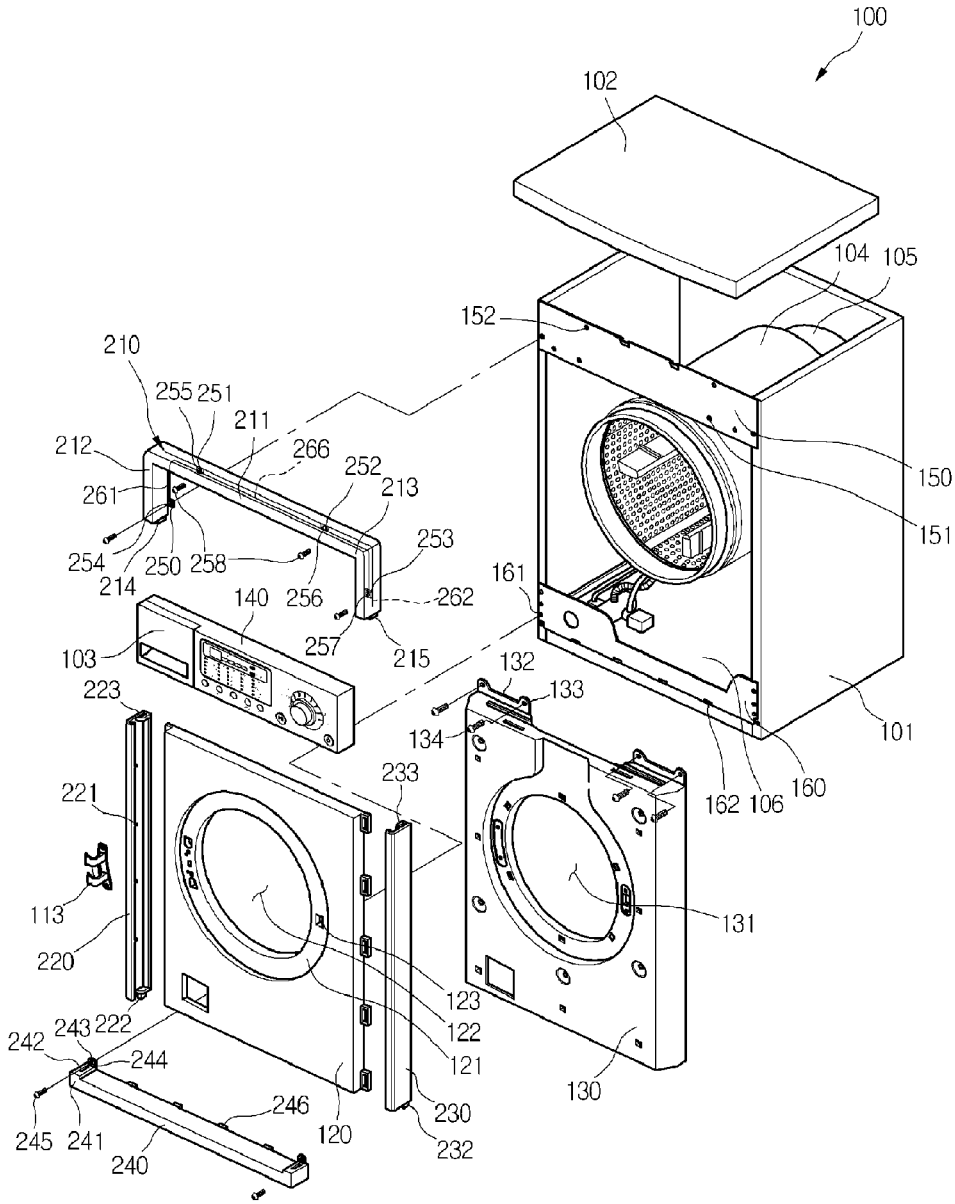
[Fig. 3]
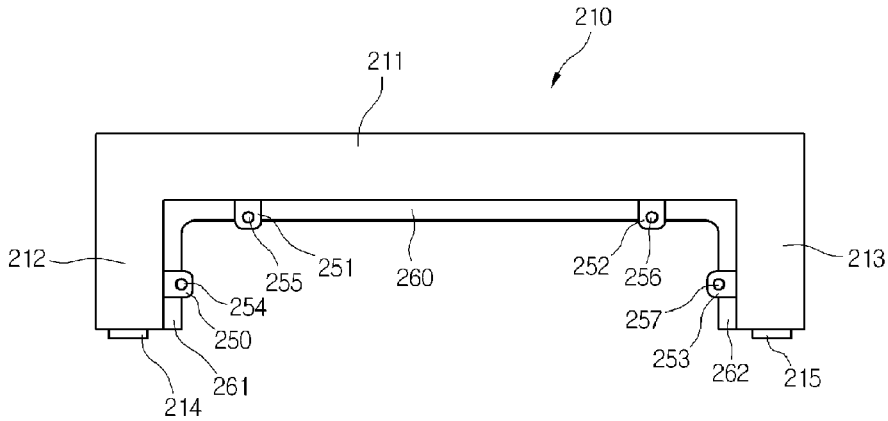

[Fig. 4]
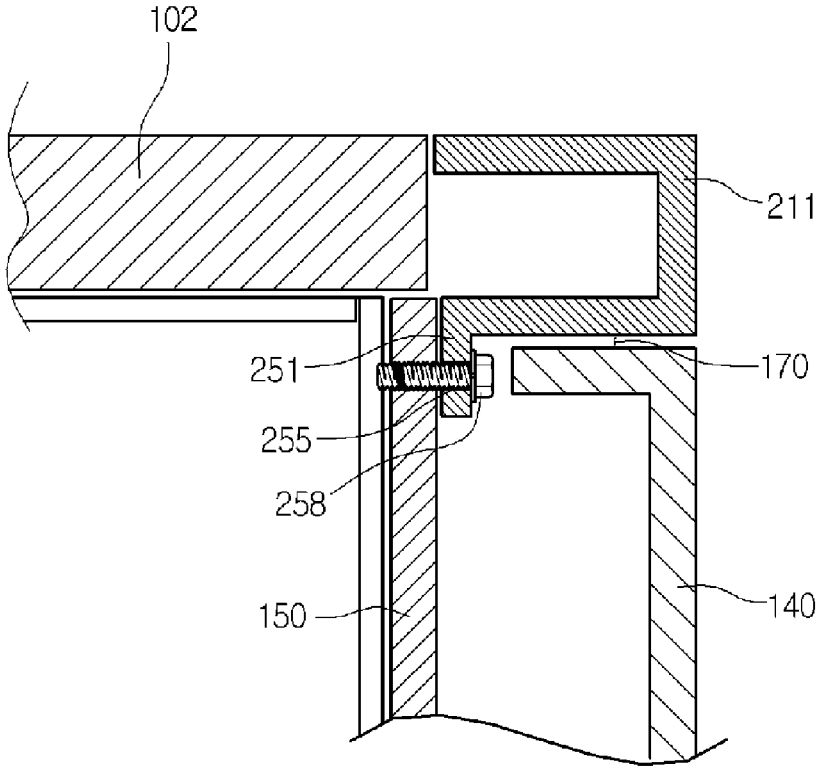
[Fig. 5]
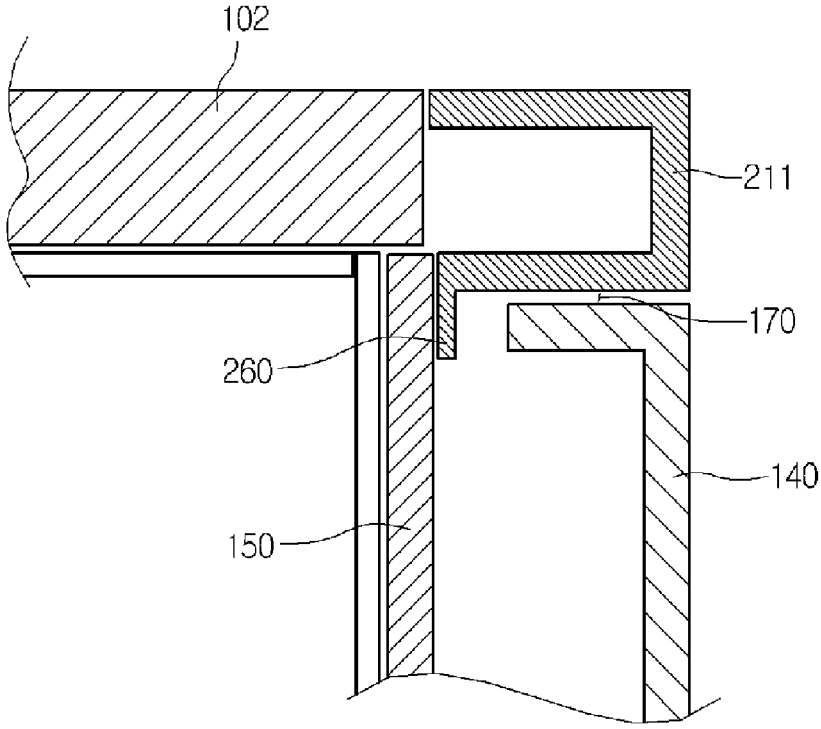

[Fig. 6]
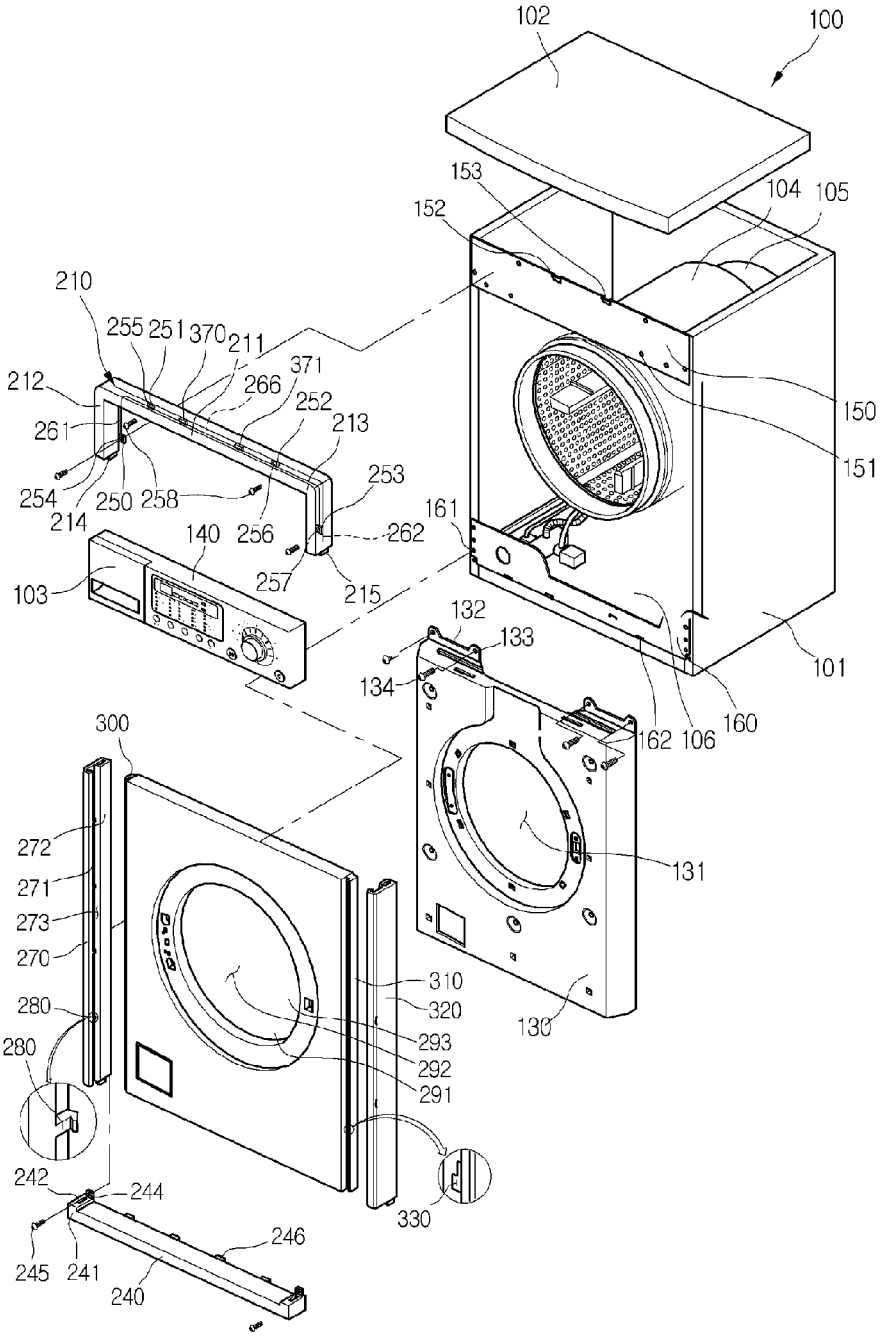
[Fig. 7]
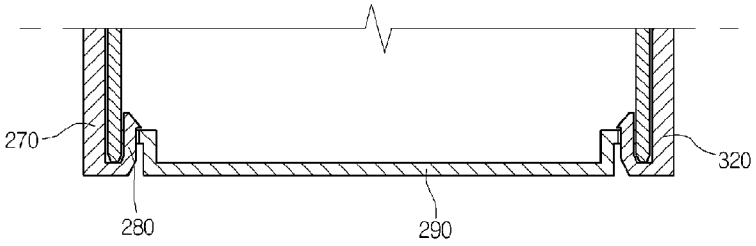

[Fig. 8]
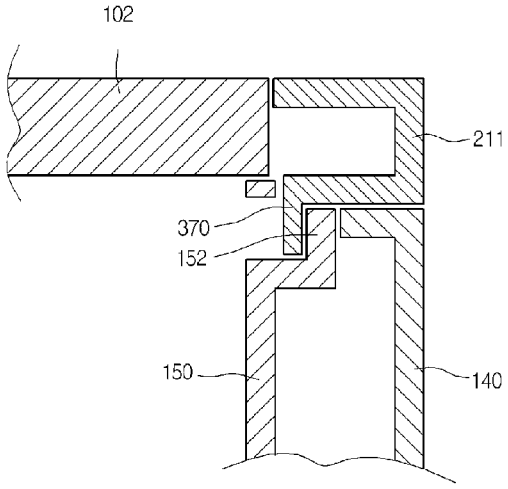
[Fig. 9]
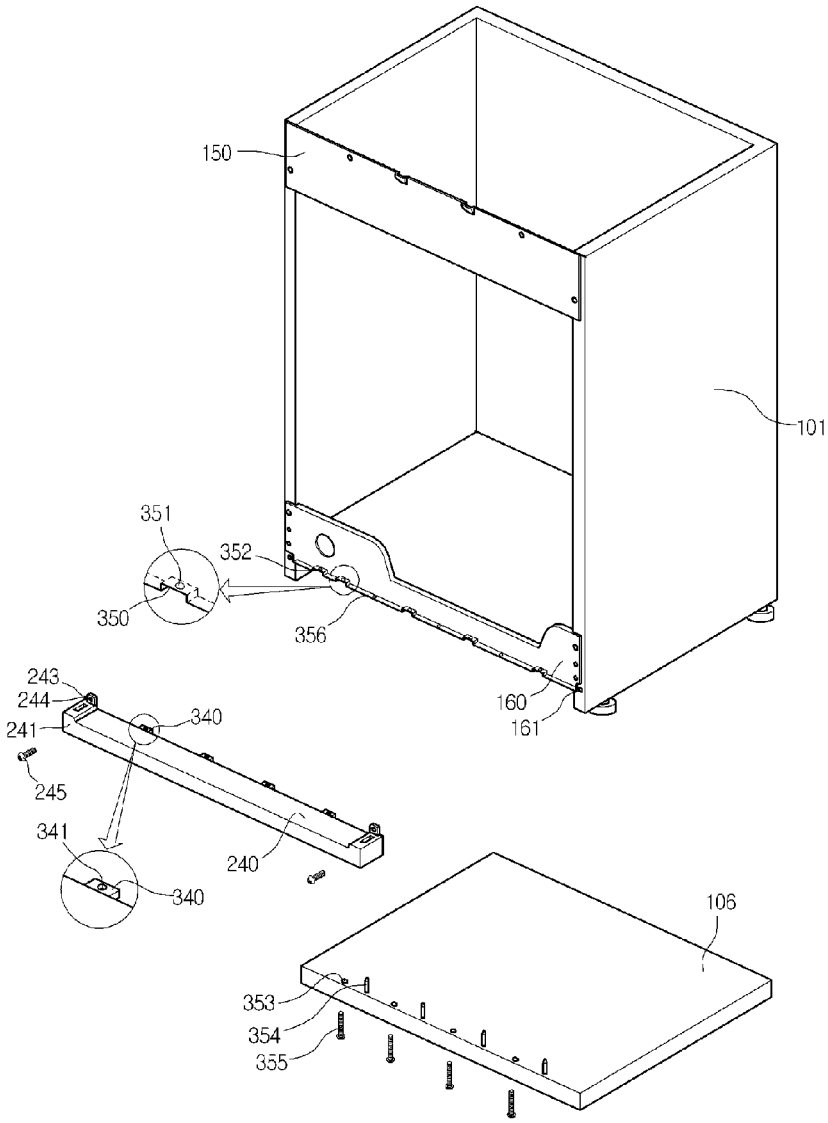

[Fig. 10]
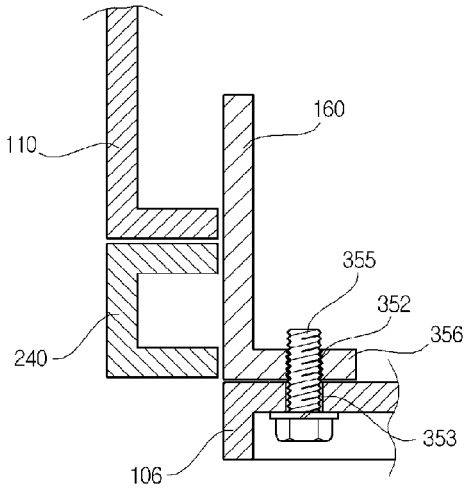
[Fig. 11]
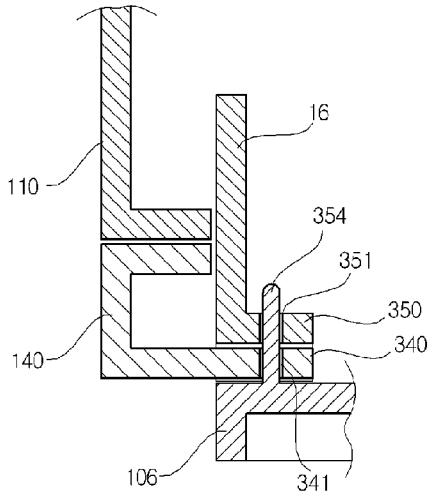
[Fig. 12]
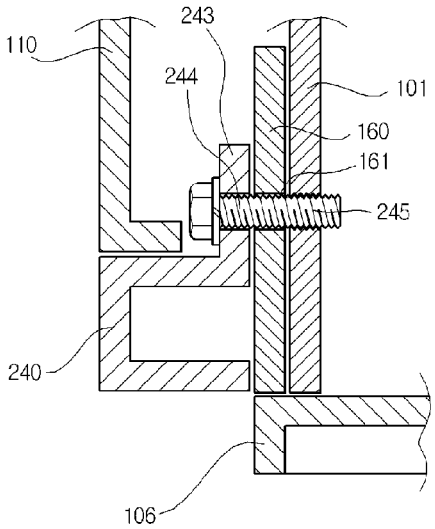

[Fig. 13]
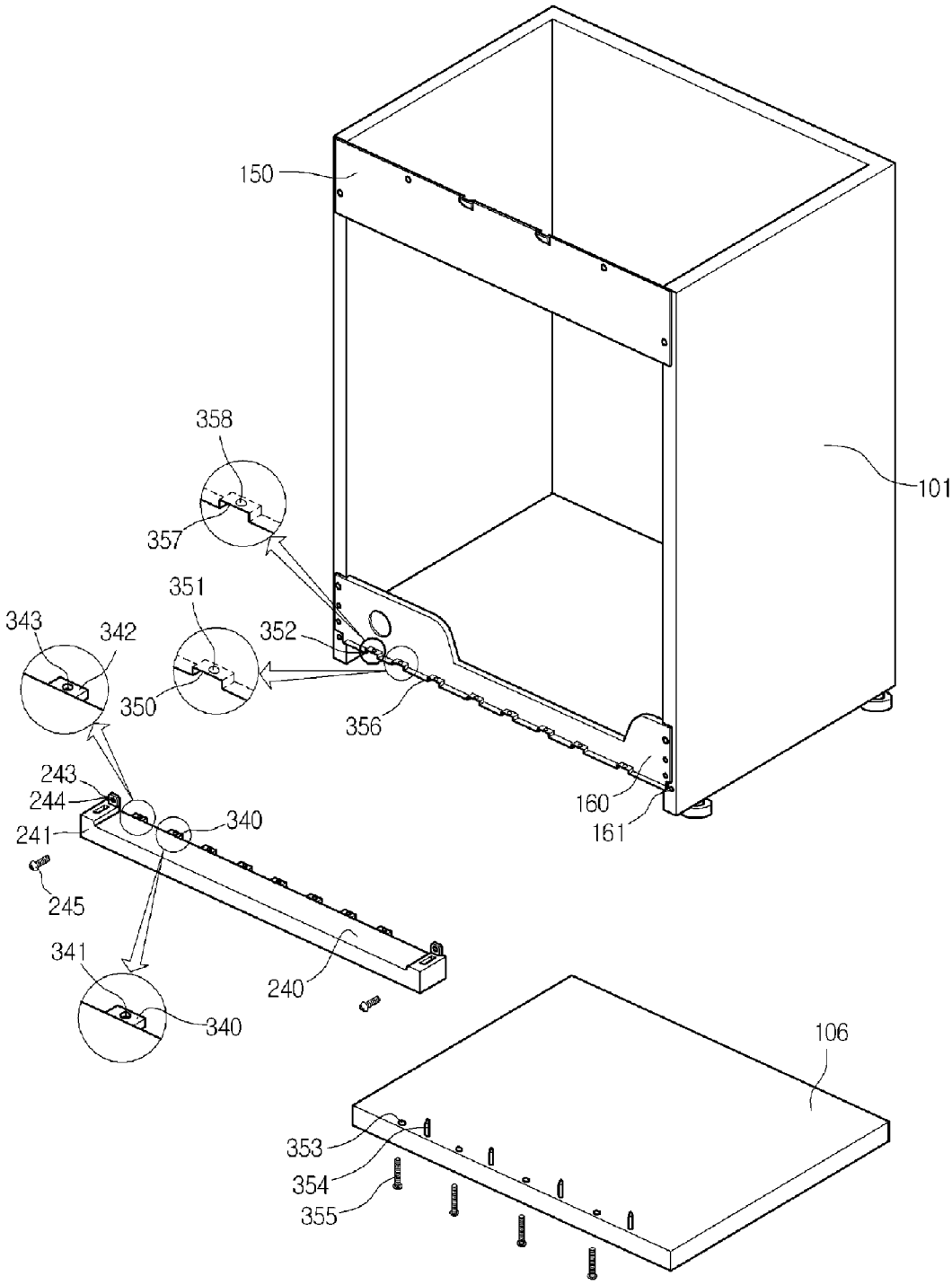

[Fig. 14]
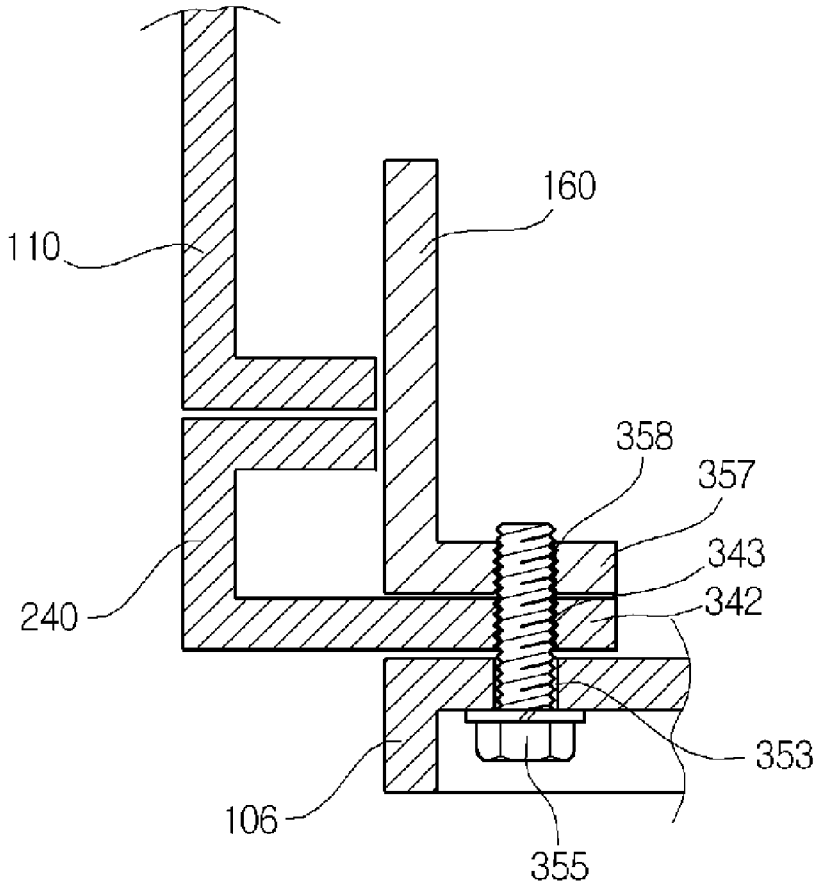

WASHING MACHINE

This application claims the benefit of PCT/KR2006/000795 filed Mar. 7, 2006, which claims the benefit of Korean Patent Application Nos. 10-2005-0019142 filed Mar. 8, 2005, 10-2005-0019143 filed Mar. 8, 2005, 10-2005-0019144 filed Mar. 8, 2005 and 20-2005-10496 filed Apr. 15, 2005, all of which are hereby incorporated by reference as if fully set forth herein.

TECHNICAL FIELD

The present invention relates to a washing machine.

BACKGROUND ART

A washing machine uses a mixture of water supplied into a tub and detergent (hereinafter referred to as 'wash liquid') to remove impurities from clothes and bed linen (hereinafter referred to as 'laundry') in a wash, rinse, and spin cycle, in order to wash laundry.

A washing machine has a control panel with various displays and buttons and a control unit installed thereon. A door is installed at the front of the washing machine, and the control panel may be installed above the door. That is, the control panel may be installed at the front, upper portion of the washing machine.

The control panel and/or the door may be scratched, dented, or otherwise damaged during transporting of the washing machine or contact thereof with other objects during its operation. In the case, components installed on the control panel and/or door may be damaged as well, whereby the washing machine may operate improperly.

In addition, when the control panel and/or door suffer external damage, the overall appearance of the washing machine is compromised, diminishing a customer's favorable impression of and satisfaction with the product.

In order to solve the above problem by replacing the control panel and/or door, the components installed on the control panel and/or door that has/have not been damaged must also be replaced, substantially raising cost.

DISCLOSURE OF INVENTION

Technical Problem

To solve the above problem, the present invention provides a washing machine capable of protecting a control panel and door forming the front portion of the washing machine from damage due to external shocks.

Another object of the present invention is to provide a washing machine that allows replacement of parts damaged from external shocks at a minimal cost.

Technical Solution

According to an aspect of the present invention, there is provided a washing machine including: a front frame formed at a front of the washing machine; a front portion disposed at a front of the front frame; and a deco panel installed around a perimeter of the front portion for covering the perimeter.

According to another aspect of the present invention, there is provided a washing machine including: a front upper frame formed at a front upper portion of the washing machine; a control panel disposed at a front of the front upper frame; and a deco panel installed around a perimeter of the control panel for covering the perimeter.

According to a yet another aspect of the present invention, there is provided a washing machine including: a front portion forming a front of the washing machine; a deco panel installed around a perimeter of the front portion for covering the perimeter; and a barrier disposed between the deco panel and the front portion, the barrier for preventing an exposing of interior components through a gap between the deco panel and the front portion.

According to a further aspect of the present invention, there is provided a washing machine including: a front portion forming a front of the washing machine; a deco panel installed around a perimeter of the front portion for covering the perimeter; and a guiding protrusion and a guiding slot respectively formed on the front portion and the deco panel, for mutually sliding and coupling the deco panel to the front portion.

According to a still further aspect of the present invention, there is provided a washing machine including: a base forming a bottom of the washing machine; a front lower frame disposed at a front of the base; a front portion disposed at a front of the front lower frame; and a deco panel installed around a perimeter of the front portion for covering the perimeter.

Advantageous Effects

An advantage of the washing machine according to the present invention is that it employs a deco panel around its front portion, so that shocks incurred on the front portion through collisions with external objects can be absorbed to a predetermined degree by the deco panel. Therefore, damage to the front portion can be prevented.

Another advantage of the washing machine according to the present invention is that through the use of the deco panel, when an external shock exceeding the absorbing limits of the deco panel is incurred, the deco panel may be scratched, dented, cracked, or otherwise damaged, and the rest of the front portion may be unscathed as a result. In other words, when damage is incurred by a shock, the damage is limited to the deco panel. Therefore, damage to the front portion can be minimized. Thus, when shock-induced damage is inflicted, only the deco panel may be replaced, to reduce part re-placement costs.

A further advantage of the washing machine according to the present invention is that by dividing the deco panel into an upper, left, right, and lower deco panel, only the damaged part of the deco panel needs to be replaced. Therefore, by replacing a part of the deco panel, the cost of part replacement can be further reduced.

A still further advantage of the washing machine according to the present invention is that a thin body barrier is formed to extend downward from the rear of the panel body, and corresponding thin left and right barriers extend inward from the rear of left and right bent portions. The body barrier and left and right barriers prevent the front upper frame or other interior components from being visible through the gap between the upper deco panel and the control panel from the outside. Therefore, even if no exterior finishing is used on the front upper frame, the washing machine can retain an aesthetic outward appearance.

An additional advantage of the washing machine according to the present invention is that because a guiding protrusion slides into a guiding slot, the left and right deco panels can be easily coupled with the front cover.

BRIEF DESCRIPTION OF THE DRAWINGS

FIG. 1 is a frontal perspective view of a washing machine according to the first embodiment of the present invention.

FIG. 2 is a frontal, exploded perspective view of a washing machine according to the first embodiment of the present invention.

FIG. 3 is a frontal view of an upper deco panel of a washing machine according to the first embodiment of the present invention.

FIG. 4 is a schematic sectional view of a fastened upper deco panel of a washing machine according to the first embodiment of the present invention taken at the center of its coupling portion.

FIG. 5 is a schematic sectional view of a fastened upper deco panel of a washing machine according to the first embodiment of the present invention taken at the center of the panel body.

FIG. 6 is a frontal, exploded perspective view of a washing machine according to the second embodiment of the present invention.

FIG. 7 is a horizontal sectional view showing left and right deco panels coupled to the front cover of a washing machine according to the second embodiment of the present invention.

FIG. 8 is a schematic sectional view of a fastened upper deco panel of a washing machine according to the second embodiment of the present invention taken at the center of the panel body.

FIG. 9 is an exploded perspective view of the front of a washing machine according to the third embodiment of the present invention.

FIG. 10 is a schematic sectional view showing an assembled lower portion of a washing machine according to the third embodiment of the present invention taken at the center of a through-hole formed in a base.

FIG. 11 is a schematic sectional view showing an assembled lower portion of a washing machine according to the third embodiment of the present invention taken at the center of a through-protrusion formed on a base.

FIG. 12 is a schematic sectional view showing an assembled lower portion of a washing machine according to the third embodiment of the present invention taken at the center of a coupling portion formed in a lower deco panel.

FIG. 13 is an exploded perspective view of the front of a washing machine according to the fourth embodiment of the present invention.

FIG. 14 is a schematic sectional view showing an assembled lower portion of a washing machine according to the third embodiment of the present invention taken at the center of a through-hole formed on a base.

BEST MODE FOR CARRYING OUT THE INVENTION

Hereinafter, preferred embodiments of a washing machine according to the present invention will be described in detail with reference to the accompanying drawings.

FIG. 1 is a frontal perspective view of a washing machine according to the first embodiment of the present invention, and FIG. 2 is a frontal, exploded perspective view of a washing machine according to the first embodiment of the present invention.

Referring to FIGS. 1 and 2, a washing machine 100 according to the present invention includes a cabinet 101 forming the exterior thereof, and a top cover 102 and a base 106 respectively disposed at the top and bottom of the cabinet 101. A tub 104 (in which laundry and wash liquid are stored) within a drum, and a motor 105 for driving the drum are installed within the cabinet 101.

A cabinet cover 130 is installed at the front of the cabinet 101, and a front cover 120 is installed at the front of the cabinet cover 130. A control panel 140 is installed above the front cover 120. The front cover 120 and the control panel 140 may define the front portion 110 of the washing machine 100. A door 111 is installed at the front portion 110 to open and close an entry/exit for laundry.

In the present invention, a deco panel 200 is installed according to the perimeter of the front portion 110. The deco panel 200 may include an upper deco panel 210, a left deco panel 220, a right deco panel 230, and a lower deco panel 240.

A front upper frame 150 and a front lower frame 160 are respectively installed across the front upper and lower portions of the cabinet 101. The front upper frame 150 and the front lower frame 160 respectively have coupling holes 151, 152, and 161 formed therein. The coupling holes 151 are for coupling the cabinet cover 130, the coupling holes 152 are for coupling the upper deco panel 210, and the coupling holes 161 are for coupling the lower deco panel 240.

The cabinet cover 130 is installed between the cabinet 101 and the front cover 120, covers the cabinet 101, and supports the front cover 120. A circular laundry insert hole 131 is formed in the cabinet cover 130. For easy insertion and extraction of laundry, the center of the laundry insert hole 131 may be aligned with that of the tub 104.

A coupling panel 132 is formed at the upper left and right portions of the cabinet cover 130. A plurality of coupling holes 133 are formed on each coupling panel 132 at either end thereof. A coupler 134, such as a bolt, passes through the coupling hole 133. The coupler 134 couples to the coupling hole 151 of the front upper frame 150. In this way, the upper portion of the cabinet cover 130 can be fastened to the front upper frame 150.

The front cover 120 covers the cabinet cover 130 and forms the front external portion of the washing machine 100. A laundry insert hole 122, corresponding to the laundry insert hole 131 of the cabinet cover 130, is formed on the front cover 120. A door receiving portion 121 is recessed a predetermined depth at the peripheral region of the laundry insert hole 122. The door 111 can be received in the door receiving portion 121.

The door 111 is pivotably connected to the front cover 120 on hinges 113 to open and close the laundry insert hole 122. A hook 112 is formed at the rear of the door 111. The hook 112 hooks into a coupling hole 123 formed in the door receiving portion 121, to fasten the door 111 to the door receiving portion 121.

The control panel 140 is installed above the front cover 120. A display 141, control buttons 142, start button 143, on/off button 144, dial knob 145, and various other controlling parts, and a control unit (not shown) are installed on the control panel 140. A detergent box 103, for inputting detergent, is installed to one side of the control panel 140.

The upper deco panel 120 is installed around the perimeter of the control panel 140. The left, right, and lower deco panels 220, 230, and 240 are installed respectively on the left and right sides and the bottom of the front cover 120. When the deco panel 200 is installed in the above manner, the deco panel 200 surrounds the edges of the front portion 110 formed by the control panel 140 and the front cover 120.

When the edges of the front portion 110 are thus covered with the deco panel 200, even if a shock is incurred on the front portion 110 from a collision with an external object, the shock can be absorbed to a certain extent by the deco panel 200. Damage to the front portion 110 can therefore be prevented. To maximize the shock absorption capability, the deco panel 200 may be made of a rubber or plastic material.

When the shock exceeds the deco panel's 200 absorption limits, the deco panel 200 is scratched, dented, cracked, or otherwise damaged, and can protect the front portion 110. Specifically, even if damage is incurred by the shock, the damage may be limited to the deco panel 200. Accordingly, damage to the front portion 110 can be minimized. Thus, when damage is caused by an external shock, only the deco panel 200 needs to be replaced, reducing the cost of replacement parts.

The deco panel 200 is divided into separate upper, left, right, and lower deco panel 210, 220, 230, and 240 components, so that only the damaged part can be replaced. Thus, the cost of replacing parts is reduced by this type of deco panel 200.

Below, each part of the deco panel 200 will be described. The upper deco panel 210 will be described later with reference to FIG. 3. Here, the left and right deco panels 220 and 230, and the lower deco panel 240 will be described.

The left and right deco panels 220 and 230 are formed along the lengths of the sides of the front cover 120 to protect both sides of the front cover 120.

Coupling holes 223 and 233 are formed at the tops of the left and right deco panels 220 and 230. The coupling protrusions 214 and 215, formed on the upper deco panel 210, respectively insert into the coupling holes 223 and 233. Through this coupling, the upper deco panel 210 may be fixed to the left and right deco panels 220 and 230.

Coupling protrusions 222 and 232 are also formed at the bottoms of the left and right deco panels 220 and 230. The coupling protrusions 222 and 232 couple respectively with coupling holes formed in either end of the lower deco panel 240. Through this coupling, the left and right deco panels 220 and 230 may be fixed to the lower deco panel 240.

The left and right deco panels 220 and 230 may each have a plurality of hooks 221 formed on their right/left sides. These hooks 221 hook onto predetermined portions of the front cover 120 to fasten the left and right deco covers 220 and 230 with the front cover 120.

The lower deco panel 240 is formed along the length of the lower end of the front cover 120 to protect the lower end of the front cover 120.

Both end portions of the lower deco panel 240 have protruding portions 241 formed to protrude upwards. The coupling hole 242 is formed roughly in the center of the protruding portion 241. As described above, the coupling protrusions 222 and 232 of the left and right deco panels 220 and 230 insert into the coupling holes 242.

A coupling portion 243 is formed to protrude upward from the rear of the protruding portion 241. The coupling portion 243 has a coupling hole 244 formed therein. A coupling member 245 passes through the coupling hole 244. The coupling member 245 that passes through the coupling hole 244 fastens to a coupling hole 161 of the front lower frame 160. In this way, the lower deco panel 240 may be fixed to the front lower frame 160.

A plurality of coupling protrusions 246 may be formed at the rear of the lower deco panel 240, spaced a predetermined distance from each other. The coupling protrusions 246 insert into coupling holes 162 formed in the front lower frame 160. Then a supporting structure is formed for the lower deco panel 240 along its length, which reinforces the coupling between the lower deco panel 240 and the front lower frame 160. Accordingly, the lower deco panel 240 may be reliably fastened to the front lower frame 160.

FIG. 3 is a frontal view of an upper deco panel of a washing machine according to the first embodiment of the present invention.

Referring to FIG. 3, the upper deco panel 210 includes a panel body 211 extending across the length of the control panel 140, and left and right bent portions 212 and 213 respectively bent to extend downward from the panel body 211 at the left and right ends thereof. The panel body 211 and the left and right bent portions 212 and 213 may have a thickness corresponding to that of the control panel 140.

A body barrier 260 is thinly formed to extend downward from the rear bottom surface of the panel body 211. Also, a left and a right barrier 261 and 262 are thinly and respectively formed to extend inward from the inner rear edges of the left and right bent portions 212 and 213. The body barrier 260 and the left and right barriers 261 and 262 block the gap formed between the upper deco panel 210 and the control panel 140 that would otherwise expose the front upper frame 150 or other inner components to the outside. In employing these barriers, even if separate exterior treatment is not used, a clean outer appearance of the washing machine 100 can be realized.

A coupling portion is formed on the upper deco panel 210. In further detail, coupling portions 251 and 252 are formed to extend down from the rear of the panel body 211, and coupling portions 254 and 253 are formed to extend inward from the inner rear surfaces of the left and right bent portions 212 and 213. The coupling portions 251, 252, 253, and 254 respectively have a coupling hole 255, 256, 257, and 258 formed therein. The coupling portions 251, 252, 253, and 254 are spaced a predetermined distance apart from one another and are formed on each part of the upper deco panel 210, so that the upper deco panel 210 may be securely fixed to the front upper frame 150.

Here, the coupling portions 251, 252, 253, and 254 may be respectively formed integrally with the body barrier 260 and the left and right barriers 261 and 262. In this case, the portions of the barriers 260, 261, and 262 on which the coupling portions 251, 252, 253, and 254 are formed may be formed thicker than the remaining barrier portions, so that the thinly formed barriers 260, 261, and 262 are not damaged when the coupling members are coupled therein.

A coupling protrusion 214 and 215 are respectively formed to protrude from the lower ends of the left and right bent portions 212 and 213. The coupling protrusions 214 and 215 respectively couple with the coupling holes 223 and 233 formed on the upper ends of the left and right deco panels 220 and 230, to fix the upper deco panel 210 to the left and right deco panels 220 and 230.

FIG. 4 is a schematic sectional view of a fastened upper deco panel of a washing machine according to the first embodiment of the present invention taken at the center of its coupling portion, and FIG. 5 is a schematic sectional view of a fastened upper deco panel of a washing machine according to the first embodiment of the present invention taken at the center of the panel body.

Referring to FIGS. 4 and 5, the control panel 140 is installed in front of the front upper frame 150. The upper deco panel 210 is installed above the control panel 140.

The body barrier 260 and the coupling portion 251 are formed at the rear of the upper deco panel 210. The body barrier 260 is formed to extend further downward then the gap 170 formed between the upper deco panel 210 and the control panel 140. Accordingly, the front upper frame 150 or other interior parts will not be visible from the outside through the gap 170.

Mode for the Invention

Alternate embodiments according to the present invention will be described below. Here, like parts as those already described in the first embodiment shall be deemed included, and thus their description will be omitted herefrom.

FIG. 6 a frontal, exploded perspective view of a washing machine according to the second embodiment of the present invention, and FIG. 7 is a horizontal sectional view showing left and right deco panels coupled to the front cover of a washing machine according to the second embodiment of the present invention.

Referring to FIGS. 6 and 7, the left and right deco panels 270 and 320 are installed at either side of the front cover 290.

A guiding protrusion 310 is formed on either side of the front cover 290. The guiding protrusion 310 extends vertically along the front cover 290. A slot front portion 271 and a slot rear portion 272 are respectively formed along the front and rear inner portions of the left and right deco panels 270 and 320. A guiding slot 273 is formed between the slot front and rear portions 271 and 272.

In this embodiment, the guiding protrusion 310 slides into the guiding slot 273, in order to easily couple the left and right deco panels 270 and 320 to the front cover 290.

The head portion of the guiding protrusion 310 protrudes further outward than its base, to catch in the guiding slot 273. Accordingly, the guiding protrusion 310 is inserted and guided in the guiding slot 273, so that it does not detach from the guiding protrusion 310. In this way, the left and right deco panels 270 and 320 may be securely fixed to the front cover 290.

A hook 280 is formed on the left and right deco panels 270 and 320. A hook receptacle 330 is formed on either side of the front cover 290 for the hook to latch into. When the hook 280 hooks in the front cover 290, the left and right deco panels 270 and 320 are firmly fixed to the front cover 290, allowing the left and right deco panels 270 and 320 to be more reliably fixed to the front cover 290.

Hook protrusions 370 and 371 are formed on the upper deco panel 210. Specifically, the hook protrusions 370 and 371 extend downward from the rear of the panel body 211. The hook protrusion 370 and 371 may be formed between the coupling portions 251 and 252 formed on the panel body 211.

Hook receptacles 152 and 153 are formed in the upper portion of the front upper frame 150. The hook protrusions 370 and 371 hook into the hook receptacles 152 and 153. In this way, the hook protrusion 370 and 371 act as supporting points in addition to the coupling portions 251, 252, 253, and 254. Thus, the upper deco panel 210 can be more securely mounted on the front upper frame 150.

FIG. 8 is a schematic sectional view of a fastened upper deco panel of a washing machine according to the second embodiment of the present invention taken at the center of the panel body.

Referring to FIG. 8, a hook receptacle 152 is formed to protrude forward and bend from the top of the front upper frame 150. A hook protrusion 370 is formed at the bottom of the upper deco panel 210.

When the upper deco panel 210 is coupled to the front upper frame 150, the hook protrusion 370 hooks onto the hook receptacle 152. Thus, the hook protrusion 370 and the hook receptacle 152 form a supporting point for the upper deco panel 210 and the front upper frame 150. Accordingly, the upper deco panel 210 and the front upper frame 150 are more securely supported.

Also, when the upper deco panel 210 is coupled to the front upper frame 150, the hook protrusion 370 may first be hooked onto the hook receptacle 152. This case may be defined as a pre-assembly of the upper deco panel 210 to the front upper frame 150. When such a pre-assembly is performed, aligning of the front upper frame 150 and the upper deco panel 210 is easier. Consequently, the assembly of the front upper frame 150 to the upper deco panel 210 may become easier.

FIG. 9 is an exploded perspective view of the front of a washing machine according to the third embodiment of the present invention.

Referring to FIG. 9, a front lower frame 160 is installed at the front of the cabinet 101. The lower deco panel 240 is installed on the front lower frame 160. A base 106 is installed at the bottom of the cabinet 101.

A coupling protrusion 340 is formed to protrude rearward from the rear of the lower deco panel 240. The coupling protrusion 340 may be formed in plurality, whereupon the coupling protrusions 340 are separated from each other by a predetermined distance and may form supporting points evenly across the rear of the lower deco panel 240. A protrusion through-hole 341 is formed in a vertical direction through the coupling protrusion 340.

A coupling protrusion mount 350 is formed on a lower end portion 356 of the front lower frame 160. The coupling protrusion 340 couples to the coupling protrusion mount 350. In order for an easy coupling, the coupling protrusion mount 350 may be recessed to correspond to the shape of the coupling protrusion 340. A mount through-hole 351 is formed in a vertical direction through the coupling protrusion mount 350 to correspond to the position of the protrusion through-hole 341 of the coupling protrusion 340. Also, a lower end coupling hole 352 is formed in the lower end portion 356 of the front lower frame 160.

A base through-hole 353 is formed in a vertical direction through the front portion of the base 106. A coupling member 355 is inserted through the base through-hole 353. A through-protrusion 354 is formed beside the base through-hole 353 to protrude upward from the base 106. Both the base through-hole 353 and the through-protrusion 354 may be formed in plurality. The base through-hole 353 and the through-protrusion may be alternately formed with even distances therebetween.

Here, top portion of the through-protrusion 354 may be pointedly formed, so that the through-protrusion 354 may easily be inserted into a corresponding hole, for an easy coupling thereof.

The coupling of the above-described base 106, lower deco panel 240, and the front lower frame 160 will now be explained lower deco panel 240 is installed on the front lower frame 160, the coupling protrusion 340 is positioned at the coupling protrusion mount 350. Here, the mount through-hole 351 and the protrusion through-hole 341 are aligned.

When the base 106 is installed on the lower deco panel 240, the through-protrusion 354 inserts through the protrusion through-hole 341 and the mount through-hole 351. In this way, horizontal movement of the base 106, lower deco panel 240, and front lower frame 160 can be prevented.

Next, the coupling member 355 inserts through the base through-hole 353 and couples to the lower end coupling hole 352. Thus, the coupling force of the coupling member 355 and the coupling hole 352 fastens the base 106 to the front lower frame 160. In this way, the base 106 and the front lower frame 160 may be prevented from vertical movement. Here, the lower deco panel 240 has the through-protrusion 354 inserted therethrough, and is pressed against by the base 106. Accordingly, vertical movement of the lower deco panel 240 may also be prevented.

The above coupling structure can securely couple the base 106, lower deco panel 240, and the front lower frame 160 together.

FIG. 10 is a schematic sectional view showing an assembled lower portion of a washing machine according to the third embodiment of the present invention taken at the center of a through-hole formed in a base, FIG. 11 is a schematic sectional view showing an assembled lower portion of a washing machine according to the third embodiment of the present invention taken at the center of a through-protrusion formed on a base, and FIG. 12 is a schematic sectional view showing an assembled lower portion of a washing machine according to the third embodiment of the present invention taken at the center of a coupling portion formed in a lower deco panel.

Referring to FIGS. 10 through 12, the lower deco panel 240 is installed at the front of the front lower frame 160. A front portion 110 is installed above the lower deco panel 240. The base 106 is installed below the front lower frame 160.

As shown in FIG. 10, the coupling member 355 inserts through the base through-hole 353 formed in the base 106, and couples to the lower end coupling hole 352 formed in the front lower frame 160.

As shown in FIG. 11, the through-protrusion 354 protruding from the base 106 inserts through the protrusion through-hole 341 formed in the lower deco panel 240 and the mount through-hole 351 formed in the front lower frame 160.

Referring to FIG. 12, the coupling member 245 inserts through the coupling hole 244 formed in the lower deco panel 240 and the coupling hole 161 formed in the front lower frame 160, and couples with the cabinet 101.

Through each of the coupling structures described above, the lower deco panel 240, the front lower frame 160, and the cabinet 101 may be securely coupled.

FIG. 13 is an exploded perspective view of the front of a washing machine according to the fourth embodiment of the present invention, and FIG. 14 is a schematic sectional view showing an assembled lower portion of a washing machine according to the third embodiment of the present invention taken at the center of a through-hole formed on a base.

Referring to FIGS. 13 and 14, a coupling protrusion 350 and a fixing hole 342 are formed in the lower deco panel 240. Correspondingly, a coupling protrusion mount 350 and a fixing protrusion mount 357 are formed at the lower end portion 356 of the front lower frame 160.

The fixing protrusion 342 is formed to extend rearward from the rear of the lower deco panel 240. The fixing hole 343 is formed in the fixing protrusion 342. In order to mount the fixing protrusion 342, the fixing protrusion mount 360 has a recessed shape. A lower end fixing hole 358 is formed in the fixing protrusion mount 357 in alignment with the fixing hole 343.

In the above structure, as shown in FIG. 14, the coupling member 355, inserted through the base through-hole 353 formed in the base 106, inserts through the fixing hole 343 of the fixing protrusion 342. The coupling member 355 then fixes into the lower end fixing hole 358 of the fixing protrusion mount 357. Thus, the base 106, lower deco panel 240, and the front lower frame 160 can be fixed.

In the fourth embodiment, the coupling member 355 inserts through not only the base 106 and the front lower frame 160, but also the lower deco panel 240. In this way, the coupling member 355 allows the fixing protrusion 342 of the lower deco panel 240 to become a supporting point for securely coupling the lower deco panel 240.

Also, by inserting the fixing protrusion 342 in the recessed fixing protrusion mount 357, lateral movement of the fixing protrusion 342 may be prevented. Accordingly, the lower deco panel 240 may be more securely coupled.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

The washing machine according to the present invention uses deco panels to protect its control panel and door from damage due to external shocks, whereby if the deco panels are damaged from external shocks, they can be replaced at a minimal cost, for a high industrial applicability.

The invention claimed is:

1. A washing machine comprising:
- a cabinet having a tub in which laundry are stored therein;
- at least one front frame formed at a front of the cabinet;
- a front cover installed at the front of the cabinet, the front cover provided with a portion to which a door is coupled;
- a cabinet cover installed between the cabinet and the front cover, the cabinet cover configured to cover the cabinet and supports the front cover;
- a control panel installed at one side of the front cover; and
- at least one deco panel installed around a perimeter of the front cover and the control panel.

2. The washing machine according to claim 1, wherein the deco panel is detachable from at least one of the front cover, the control panel, and the front frame.

3. The washing machine according to claim 1, wherein the deco panel is formed in a plurality of separate parts.

4. The washing machine according to claim 3, wherein the deco panel includes an upper deco panel, a left deco panel, a right deco panel, and a lower deco panel.

5. The washing machine according to claim 3, wherein each of the separate parts has a coupling portion formed thereon for mutually coupling.

6. The washing machine according to claim 1, wherein the deco panel forms a coupling portion through which a separate coupling member inserts, for installing the deco panel to at least one of the front cover, the control panel, and the front frame.

7. The washing machine according to claim 1, wherein the deco panel forms a sliding portion for slidably installing the deco panel onto the front portion.

8. The washing machine according to claim 1, wherein the deco panel forms a barrier for blocking the front frame.

9. The washing machine according to claim 1, wherein the deco panel forms a hook protrusion for hooking onto a predetermined portion of the front frame to support the deco panel.

10. The washing machine according to claim 1, wherein the deco panel is made of one of a rubber and a plastic material.

11. A washing machine comprising:
- a cabinet having a tub in which laundry are stored therein;
- a front upper frame formed at a front upper portion of the cabinet;
- a front cover installed at the front of the cabinet;
- a cabinet cover installed between the cabinet and the front cover, the cabinet cover defining a laundry insert hole;
- a control panel disposed at a front of the front upper frame, the rear surface of the control panel being spaced apart from the front surface of the front upper frame; and
- a deco panel installed around a perimeter of the control panel for covering the perimeter, the deco panel provided with a barrier configured to extend to a space between the front upper frame and the control panel.

12. The washing machine according to claim 11, wherein the deco panel includes an upper deco panel covering an upper end of the control panel, and a left and a right deco panel for respectively covering a left and a right side of the control panel.

13. The washing machine according to claim 11, wherein the deco panel includes a coupling portion formed on a rear portion thereof for installing the deco panel to the front upper frame.

14. The washing machine according to claim 13, wherein the coupling portion forms a hole for inserting a coupling member through, and the front upper frame forms a hole for aligning with the hole formed by the coupling portion and fixing the coupling member in.

15. The washing machine according to claim 13, wherein the coupling portion is integrally formed with the deco panel.

16. The washing machine according to claim 11, wherein the front upper frame and the deco panel respectively form a hook protrusion and a hook receptacle for hooking the hook protrusion, to fasten the front upper frame with the deco panel.

17. The washing machine according to claim 11, wherein the front upper frame and the deco panel respectively form a hook protrusion and a hook receptacle for hooking the hook protrusion, to pre-assemble the front upper frame to the deco panel in an assembling process of the front upper frame and the deco panel.

18. The washing machine according to claim 11, wherein the deco panel further comprises a panel body configured to cover a upper surface of the control panel, and the barrier extends downward from the panel body.

19. The washing machine according to claim 18, wherein the barrier extends beyond the gap to overlap with the front upper frame or the control panel at a predetermined region thereof.

20. A washing machine comprising:

a cabinet having a tub in which laundry are stored therein;

a front upper frame formed at a front upper portion of the cabinet;

a front cover installed at the front of the cabinet;

a cabinet cover installed between the cabinet and the front cover, the cabinet cover defining a laundry insert hole;

a control panel disposed at a front of the front upper frame, the rear surface of the control panel being spaced apart from the front surface of the front upper frame; and a deco panel installed around a perimeter of the control panel for covering the perimeter, the deco panel provided with a barrier configured to extend to a space between the front upper frame and the control panel, the barrier for preventing an exposing of interior components through a gap between the deco panel and the front upper portion.

21. The washing machine according to claim 20, wherein the barrier extends from the deco panel downward.

22. The washing machine according to claim 21, wherein the barrier extends beyond the gap to overlap with the front upper frame at a predetermined region thereof.

23. A washing machine comprising:

a cabinet having a tub in which laundry are stored therein;

a base forming a bottom of the cabinet;

a front lower frame disposed at a front of the base;

a front cover installed at the front of the cabinet, the front cover provided with a portion to which a door is coupled and defining a first laundry insert hole;

a cabinet cover installed between the cabinet and the front cover, the cabinet cover defining a second laundry insert hole; and a deco panel installed around a perimeter of the front cover for covering the perimeter.

24. The washing machine according to claim 23, wherein the base forms a through-hole for inserting a coupling member through, and the front lower frame forms a coupling hole therethrough for coupling the coupling member.

25. The washing machine according to claim 24, wherein the deco panel forms a through-hole for inserting the coupling member that inserts through the base therethrough.

26. The washing machine according to claim 23, wherein the base forms a through-protrusion protruding upward therefrom, and the deco panel and the front lower frame form through-holes for inserting the through-protrusion therethrough.

27. The washing machine according to claim 23, wherein the deco panel forms a protruding portion at a rear thereof, and the front lower frame forms a mounting portion corresponding to the protruding portion for mounting the protruding portion therein.

* * * * *